United States Patent [19]

Cambien

[11] Patent Number: 4,942,381

[45] Date of Patent: Jul. 17, 1990

[54] DRIVING ELEMENT WITH A THIN PART, DEFORMABLE IN THE DIRECTION OF ITS THICKNESS

[75] Inventor: Jean C. Cambien, Sassenage, France

[73] Assignee: Delta Concept S.A., Grenoble, France

[21] Appl. No.: 433,246

[22] Filed: Nov. 9, 1989

Related U.S. Application Data

[62] Division of Ser. No. 315,376, Oct. 26, 1988, Pat. No. 4,914,415.

[30] Foreign Application Priority Data

Feb. 27, 1987 [FR] France ..... 87 02685

[51] Int. Cl.[5] ..... H01H 37/52

[52] U.S. Cl. ..... 337/370; 337/335; 337/354

[58] Field of Search ..... 337/370, 371, 372, 335, 337/336, 354, 95, 38, 40, 379

[56] References Cited

U.S. PATENT DOCUMENTS 4,325,047 4/1982 Inada et al. ..... 337/371

4,499,448 2/1985 Grable ..... 337/370

*Primary Examiner*—H. Broome

*Attorney, Agent, or Firm*—Armstrong, Nikaido, Marmelstein, Kubovcik & Murray

[57] ABSTRACT

Driving element (1) comprising a thin part (2) provided with a zone, ductile in the direction of its thickness in such a way as to occupy at least two positions, in at least one of which said zone is arc-shaped, at least one tab (3, 4) fixed at one end to a face of said ductile zone and extending towards the central part of the zone in such a way that, when the zone is molded, the free end (8, 9) of said tab moves away from or towards the face (5) of said thin part, the resulting amplitude of the movement of the free end of the tab being greater than the amplitude of ductility of the thin piece.

6 Claims, 3 Drawing Sheets

DRIVING ELEMENT WITH A THIN PART, DEFORMABLE IN THE DIRECTION OF ITS THICKNESS

This is a division, of application Ser. No. 315,376 filed Oct. 26, 1988 U.S. Pat. No. 4,914,415.

The present invention concerns a driving element comprising a thin part featuring an area deformable in the direction of its thickness so as to occupy at least two positions in at least one of which said area is arcuate.

Driving elements consisting only of a thin part deformable in this manner are already known. However, the travel obtained from such deformation, which permits the actuation of a member to be commanded, is small. This small travel results in disadvantages, particularly where the member to be activated is a switch.

In order to remedy these disadvantages in particular and to obtain an increased travel, the present invention proposes a driving element further comprising at least one tab extending along one surface of said deformable area towards the central part of the latter and the outer end of which is fixed to said surface, so that, the opposite edges of said deformable area and the free end of said tab respectively bearing against a support and a member to be actuated, the free end of said tab moves away from or towards said deformable area on deformation of the latter, the resulting amplitude of the movement of the free end of said tab being greater than the amplitude of deformation of said deformable area.

According to the present invention the driving element may advantageously comprise at least two opposed tabs which are fixed at one end to one surface of said deformable area and which extend towards the central part thereof.

According to another object of the present invention said thin part may be differently constituted. In one embodiment said thin part may be elastically deformable. In another embodiment said part may be constituted by a bimetallic member. In a further embodiment said thin part may have an area deformable in the direction of its thickness so as to occupy two extreme arcuate positions situated to either side of a median plane.

According to another object of the present invention the driving element may comprise at least one stack comprising two opposed thin parts respectively provided with at least one opposed tabs disposed so that the free ends of the tabs carried by one of said thin parts bear on the free ends of the tabs carried by the other thin part.

In one embodiment according to another object of the present invention said thin part is constituted by a disk, said tab or tabs extending radially of the latter.

According to another object of the present invention the driving element comprises a ring fixed to one surface of said disk-shaped thin part and provided with a multiplicity of tabs extending radially towards the central part of said disk-shaped thin part.

According to another object of the present invention said thin part has a passage in the central part of its deformable area, said tab or tabs extending substantially to the rim of said passage.

According to another object of the present invention said tab or tabs may advantageously be constituted by a bimetallic member deforming in the direction of the thickness of said thin part and in the same direction.

The present invention will be better understood from a consideration of the driving elements described by way of non-limiting example and illustrated by the drawing in which.

Figure 6:
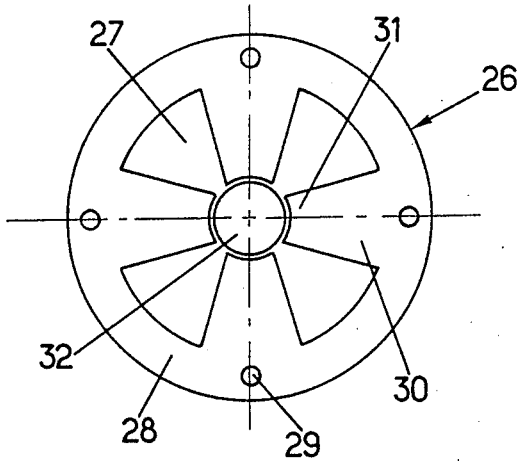
FIG. 6 represents a top view of another driving element in accordance with the present invention.
Figure 7:
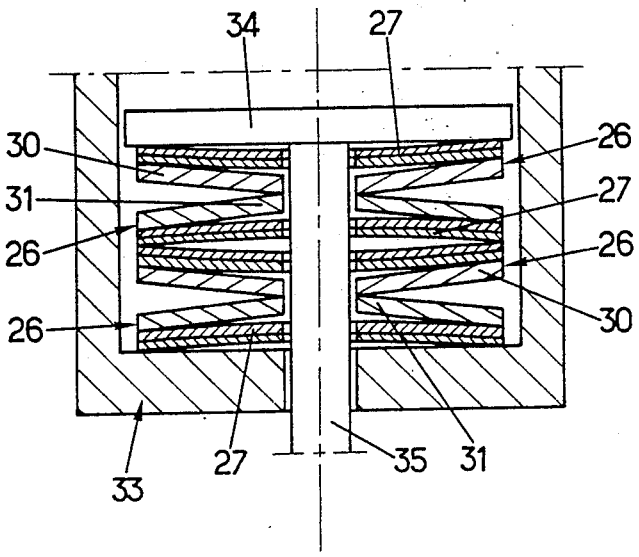

and FIG. 7 represents in cross-section a stack of several driving elements similar to that from FIG. 6.

Figure 1:
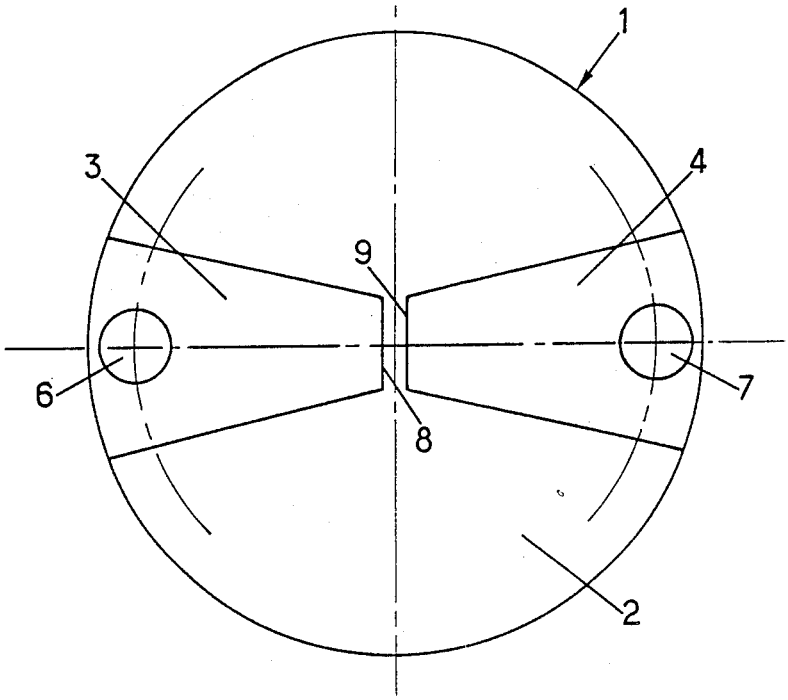
FIG. 1 represents a top view of a first driving element according to the present invention.
Figure 2:
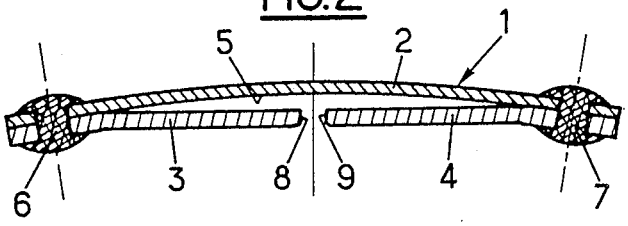
FIG. 2 represents a cross-section through the driving element from FIG. 1 in a first position.
Figure 3:
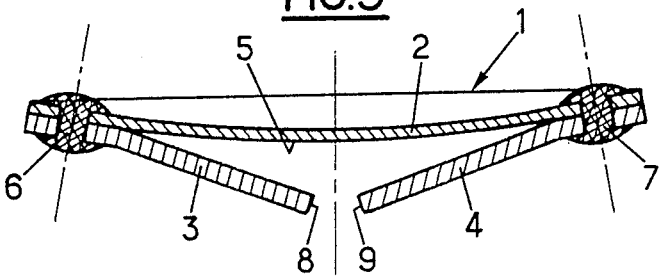
FIG. 3 represents a cross-section through the driving element from FIG. 1 in a second position.

Referring to FIGS. 1 through 3, it is seen that there has been represented a driving element generally designated by the reference 1 which comprises a disk-shaped thin part 2 which is made from a material elastically deformable in the direction of its thickness, so as to occupy a first arcuate or domed stable position visible in FIG. 2 and a second unstable position visible in FIG. 3 in which it is arcuate or domed on the other side of its median plane. Said thin part 2 is adapted to change from its stable position to its unstable position by pressing on its central part, for example, and to return to its stable position by virtue of its elasticity. As a result, the maximum amplitude of movement of said disk-shaped thin part 2 corresponds to the amplitude of the displacement of its central part.

The driving element 1 further comprises two opposed tabs 3 and 4 which extend radially to the disk 2 and the outer end of which is fixed to the concave surface 5 of said disk 2 when the latter is in its stable position visible in FIG. 2, by means of rivets 6 and 7, said tabs 3 and 4 extending towards each other along the surface 5 so that their adjacent ends 8 and 9 are situated in the central part of the disk-shaped thin part 2.

When the disk-shaped thin part 2 is deformed, as seen previously, from it stable position visible in FIG. 2 to its unstable position visible in FIG. 3, and vice versa, the free ends 8 and 9 of the tabs 3 and 4 move away from the surface 5 of the disk-shaped thin part 2 to which they are fixed, and vice versa. It follows that the resultant amplitude of the movement of the free ends 8 and 9 of the opposed tabs 3 and 4 is greater than the amplitude of deformation of the disk-shaped thin part 2.

Figure 4:
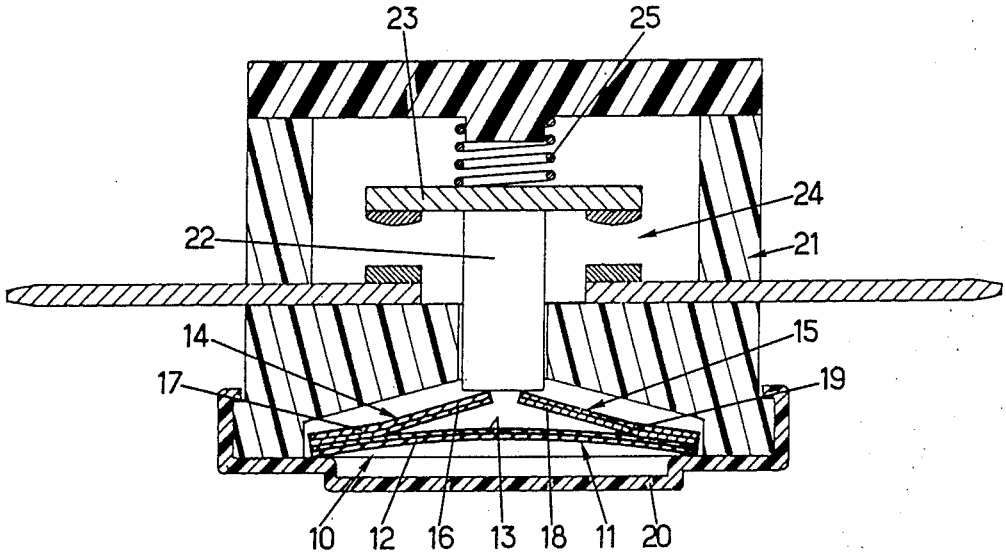
FIG. 4 represents in cross-section another driving element in accordance with the present invention, in a first position, mounted in a switch casing.
Figure 5:
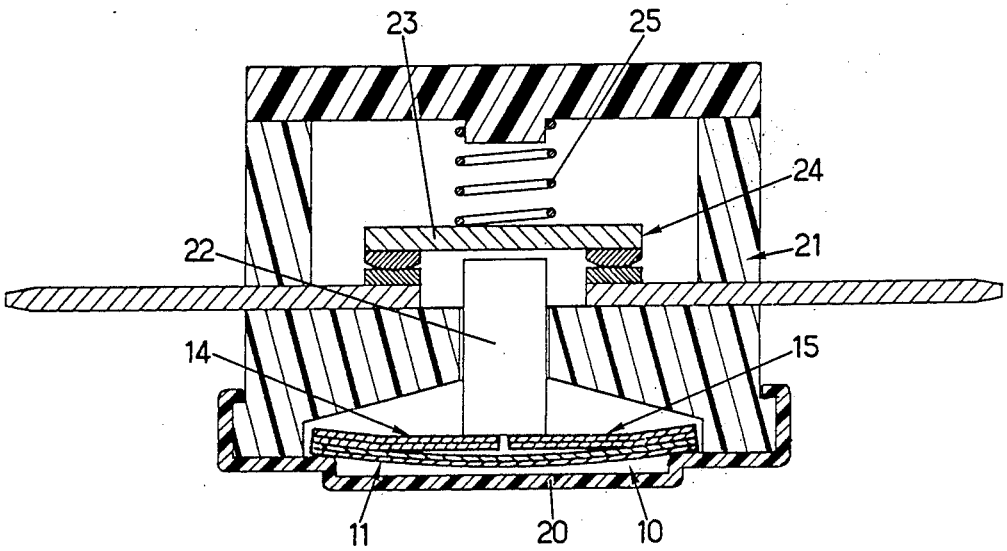
FIG. 5 represents in cross-section the driving element from FIG. 4 in a second position.

Referring now to FIGS. 4 and 5, there will be described one application of a disk-shaped element generally designated by the reference 10 which is of equivalent structure to that of the driving element 1 represented in FIGS. 1 through 3.

The driving element 10 comprises a disk-shaped thin part 11 constituted of two disks 12 and 13 fixed together so as to constitute a bimetallic member adapted to deform according to temperature in the direction of its thickness, slowly or quickly.

The driving element 10 further comprises two opposed tabs 14 and 15 which are, as in the previous example, fixed to one of the surfaces of the disk-shaped thin part 11 and which, in this instance, are both constituted of two members 16, 17 and 18, 19 fixed together to constitute bimetallic members adapted to deform according to temperature in the direction of the thickness of the disk-shaped thin part 11 and in the same direction. In this example the outer ends of the two tabs 14 and 15 are fixed to the disk-shaped thin part 11 by adhesive bonding.

The peripheral edge of the disk-shaped thin part 11 bears on the cover 20 of a switch casing 21 and the free ends of the tabs 14 and 15 bear against the end of a plunger 22 adapted to slide in the casing 21 in the direction of thickness of the disk-shaped thin part 11. The other end of said plunger 22 is adapted to move the movable member 23 of a switch generally designated by the reference 24 and mounted in the casing 21, against a spring 25.

In the event of a change in temperature the driving element 10 deforms so as to change from its position visible in FIG. 4 to its position visible in FIG. 5 or vice versa, these changes of position corresponding to the changes of position of the driving element 1 as seen previously with reference to FIGS. 2 and 3, with an increase in the amplitude of movement of the disk-shaped thin part 11 by virtue of the provision of the opposed tabs 14 and 15. Note also that the deformation of the tabs 14 and 15 constituted of bimetallic members also amplifiers the deformation of the disk-shaped thin part 11. The deformation of the driving element 10 brings about acutation of the switch 24, in the direction to open it or close it, through displacement of its mobile member 23 by the plunger 22.

Referring now to FIG. 6 it is seen that there is represented a driving element generally designated by the reference 26 which comprises a disk-shaped thin part 27 constituting as previously a bimetallic member to one surface of which is fixed by four rivets 29 a ring 28 provided with four regularly distributed tabs 30 which extend radially towards the central part of the disk-shaped thin part 27 and the internal free ends 31 of which extend to the edge of a central passage 32 provided in the disk-shaped thin part 27. This driving element is adapted to deform in the same way as the driving elements 1 and 10 previously described.

Referring to FIG. 7 it is seen that there is represented a stack of four driving elements 26 in pairs so that the free ends 31 of the tabs 30 of two adjacent disks bear against each other and the peripheral edges of the disk-shaped thin parts 27 of the two driving elements 26 at the ends of the stack bear one on a support 33 and the other on a plate 34 connected to an actuator rod 35 which extends through central passages 32 in the four stacked driving elements 26 and through the support 33, the driving elements 26 being disposed around the rod 35 and centered and guided by the latter. In the event of a change in temperature the four driving elements 26 deform in the direction of their thickness as already seen previously and enable displacement of the plate 34 and consequently of the rod 35 relative to the support 33, the amplitude of this displacement corresponding to the sum of the amplitude of the displacement of each of the four stacked driving elements 26.

The present invention is obviously not limited to the examples described hereinabove. The effect of the tabs associated with the thin part deformable in the direction of this thickness could be achieved with thin parts of different shapes and in particular with thin parts in the shape of elastically deformable rectangular strips or constituting bimetallic members, for example.

I claim:

1. Driving element comprising:

at least two disks deformable in the the direction of their thickness so as to occupy arcuate positions, each disk being provided with at least two opposed tabs extending radially and having their outer end parts fixed on an outer part of the disk and their free end being above a central area of the disk surface, said disks being disposed one on the other and forming a stack in which said disks are deformable in opposite directions, said stack being positionable between a support and a member to be actuated in the direction of an axis of said stack by the movement of said free ends of said tabs of said disks.

2. Driving element according to claim 1, wherein said disks are elastically deformable.

3. Driving element according to claim 1, wherein said disks are bimetallic.

4. Driving element according to claim 1, wherein said tabs are bimetallic.

5. Driving element according to claim 1, wherein said tabs and said disks are bimetallic and are deformable in the same direction.

6. Driving element according to claim 1, wherein said disks have a central passage, said tabs extending substantially to the rim of said passage.

* * * * *